US008607811B2

(12) United States Patent
Korkmaz

(10) Patent No.: US 8,607,811 B2
(45) Date of Patent: Dec. 17, 2013

(54) INJECTION VALVE WITH INDEXING MECHANISM

(75) Inventor: Lale Korkmaz, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 486 days.

(21) Appl. No.: 12/831,389

(22) Filed: Jul. 7, 2010

(65) Prior Publication Data

US 2012/0006553 A1 Jan. 12, 2012

(51) Int. Cl.

| | |
|---|---|
| ***F16K 17/40*** | (2006.01) |
| ***F16K 31/12*** | (2006.01) |
| ***F16K 31/44*** | (2006.01) |
| ***E21B 33/00*** | (2006.01) |
| ***E21B 34/00*** | (2006.01) |

(52) U.S. Cl.

USPC ..... 137/68.11; 137/74; 137/508; 251/230; 166/317; 166/332.8; 166/373; 166/376

(58) Field of Classification Search

USPC ..... 137/467, 459, 508, 73, 74, 68.11; 251/83, 230; 166/292, 317, 332.8, 373, 166/376

See application file for complete search history.

(56) References Cited

U.S. PATENT DOCUMENTS

| | | | | |
|---|---|---|---|---|
| 4,248,264 | A * | 2/1981 | Hadsell et al. | 137/454.2 |
| 4,458,762 | A | 7/1984 | McMahan | |
| 5,765,641 | A | 6/1998 | Shy et al. | |
| 6,026,903 | A | 2/2000 | Shy et al. | |
| 6,119,783 | A | 9/2000 | Parker et al. | |
| 6,328,109 | B1 * | 12/2001 | Pringle et al. | 166/373 |
| 6,889,771 | B1 | 5/2005 | Leising et al. | |
| 6,902,006 | B2 | 6/2005 | Myerley et al. | |
| 6,904,975 | B2 | 6/2005 | Horne et al. | |
| 6,957,703 | B2 | 10/2005 | Trott et al. | |
| 7,270,191 | B2 | 9/2007 | Drummond et al. | |
| 7,416,029 | B2 * | 8/2008 | Telfer et al. | 166/386 |
| 2004/0026085 | A1 | 2/2004 | Vacik et al. | |
| 2007/0074873 | A1 * | 4/2007 | McKeachnie et al. | 166/376 |
| 2008/0196898 | A1 | 8/2008 | Jasser et al. | |
| 2009/0020290 | A1 | 1/2009 | Ross et al. | |
| 2009/0242199 | A1 | 10/2009 | Basmajian et al. | |

OTHER PUBLICATIONS

Baker Oil Tools brochure, "Model J Wireline Retrievable Injection Valve", date unknown, 1 page.

Schlumberger brochure, "TRTO Series Injection Safety Valves", 2008, 2 pages.

Schlumberger brochure, "A-Series Injection Safety Valves", Sep. 2003, 2 pages.

* cited by examiner

*Primary Examiner* — Stephen M Hepperle
*Assistant Examiner* — Kevin Barss
(74) *Attorney, Agent, or Firm* — Steve Rosenblatt

(57) ABSTRACT

A flapper valve preferably used in injection application in deep subterranean locations has an actuating sleeve with a seat to accept an object. A j-slot connects the actuation sleeve movement to the housing so that with an object on the seat and an applied pressure cycle the sleeve moves the flapper to the open position. The plug is dissolved and the injection begins. The plug can have an opening so as to allow continuous injection flow as the flapper is operated. Closing the flapper involves a second object on the same seat and a pressure cycle so that a spring can push the sleeve away from the flapper to allow a torsion spring on the flapper to close it.

25 Claims, 4 Drawing Sheets

INJECTION VALVE WITH INDEXING MECHANISM

FIELD OF THE INVENTION

The field of this invention is valves for subterranean use that are actuated with an indexing mechanism and more particularly flapper type valves actuated with pressure cycles on a plug that can be removed after use.

BACKGROUND OF THE INVENTION

Various valve designs used in the past have incorporated sleeves indexed by j-slot devices to selectively align and misalign ports. In one example the ball that lands on a seat to allow application of pressure cycles to operate the j-slot is blown through the seat after a change in valve position. This is illustrated in U.S. Pat. No. 7,416,029. Another device is in essence a sliding sleeve that allows flow uphole and the sleeve, which is mounted to a j-slot, can be cycled from uphole as flow from uphole acts to close a flapper on top of the sleeve for pressure cycling. This is shown in US Publication 2008/0196898.

Other designs use a j-slot to unlock a lock in conjunction with a plug that can then disappear as illustrated in U.S. Pat. Nos. 5,765,641; 6,119,783 and 6,026,903. Other designs use relatively movable mandrel components where cycles of picking up and setting down weight actuate a j-slot to operate a flapper, as shown in U.S. Pat. No. 4,458,762. Some designs use a j-slot to unlock a lock so that a flapper can then operate. A plug is landed on a seat which then is dissolved. Some examples of combinations of some of these features are U.S. Pat. Nos. 7,270,191; 6,904,975 and US Publication 2009/0242199.

Other designs provide a flowpath constriction to create differential pressure on a flow tube to open a flapper. These designs such as the MC Injection Valves from Halliburton and the A Series Injection Valve from Schlumberger restrict access through the valve for advancing other tools. The Model J Wireline Retrievable Injection Valve from Baker Hughes opens on a predetermined flow through a restriction. Some hydraulically operated safety valves had a feature to lock a flapper open after the flapper was displaced with a flow tube driven by a hydraulic piston. In this design shown in U.S. Pat. No. 6,902,006 the flame holding the flapper was itself shifted when the flapper was open to catch the edge of the flapper in a top groove of a sleeve below. Yet a few other applications that use flow bore restrictions to create a force to move a tube to open a flapper are U.S. Ser. Nos. 12/433,134, filed on Apr. 30, 2009 entitled Innovative Flow Tube, 12/469,310, filed on May 20, 2009, entitled Flow-Actuated Actuator, and 12/469,272, filed on May 20, 2009, entitled Flow-Actuated Actuator and Method.

The present invention deals with flapper type valves with a preferred use in injection service. The design provides a way of operating the flapper without control lines. In deep applications there will be high hydrostatic pressure in the control line that would have to be offset with a very large return spring. While a dual control line system can offset this hydrostatic effect in deep applications there is additional expense and operational issues from doubling up the control lines and running them with a string into the subterranean location. In the preferred embodiment there is no need for control lines. A flapper is operated by a sleeve that responds to pressure cycles against a seated ball or plug to push the flapper open after a predetermined number of cycles. The ball, plug or other object is removed from its blocking position on a seat preferably by dissolving it so that flow can commence. The preferred application is injection service where water, salt water, chemicals, $CO_2$ or steam can be the flowing fluid. When it is desired to close the flapper another object can be landed in the same seat and the cycling with pressure repeated to allow a return spring to raise the flow tube so that a torsion spring on the flapper pivot can move the flapper to the closed position against its seat. As few as a single application and removal of pressure cycle can be used to change the flapper position between open and closed.

In an alternative embodiment an actuation sleeve pushes the flapper open as well as engaging or contacting a counter sleeve below that is engaged to a j-slot. On release of pressure a return spring on the counter sleeve raises it to retain the flapper in the open position while a separate return spring biases the actuation sleeve up. A second ball or other object landed in the seat of the actuation sleeve once again displaces the actuation sleeve against the counter sleeve. This time the counter sleeve is held against its return spring by the j-slot so that on release of pressure the torsion spring on the flapper allows the flapper to pivot closed when the actuation sleeve is also pushed up by its return spring. After a use of either the first or the second object, either is removed preferably by dissolving to get either object out of the flow path.

The dissolving of the object can occur by fluids such as water, saltwater in the wellbore, acid added to the wellbore, or by other reactive or dissolving agents present or added to the wellbore. Other ways to fail the object to get it out of the flow path are also contemplated.

Those skilled in the art will better appreciate the scope of the invention from a review of the description of the preferred embodiment and the associated drawings while recognizing that the full scope of the invention is determined by the appended claims.

SUMMARY OF THE INVENTION

A flapper valve preferably used in injection application in deep subterranean locations has an actuating sleeve with a seat to accept an object. A j-slot connects the actuation sleeve movement to the housing so that with an object on the seat and an applied pressure cycle the sleeve moves the flapper to the open position. The plug is dissolved and the injection begins. The plug can have an opening so as to allow continuous injection flow as the flapper is operated. Closing the flapper involves a second object on the same seat and a pressure cycle so that a spring can push the sleeve away from the flapper to allow a torsion spring on the flapper to close it. In an alternative embodiment an actuation sleeve pushes a counter sleeve that is movable through a j-slot. The first object on the actuation sleeve pushes both sleeves such that removal of pressure allows the now open flapper to be retained in the open position and the object to be dissolved or otherwise removed.

DETAILED DESCRIPTION OF THE PREFERRED EMBODIMENT

Figure 1:
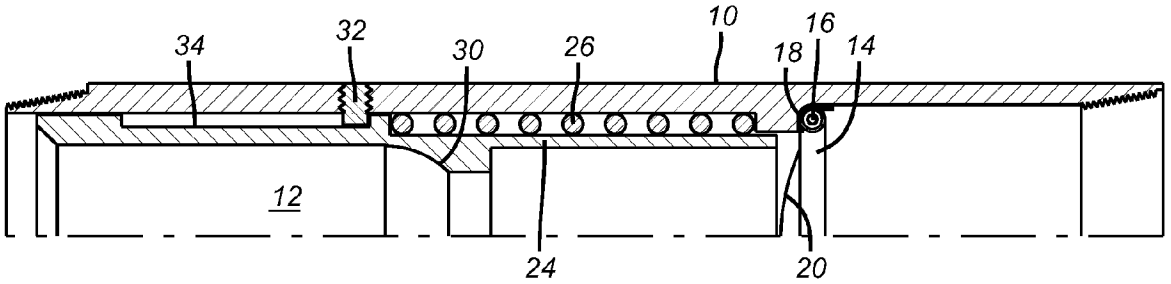
FIG. 1 is a section view with the flapper closed.
Figure 2:
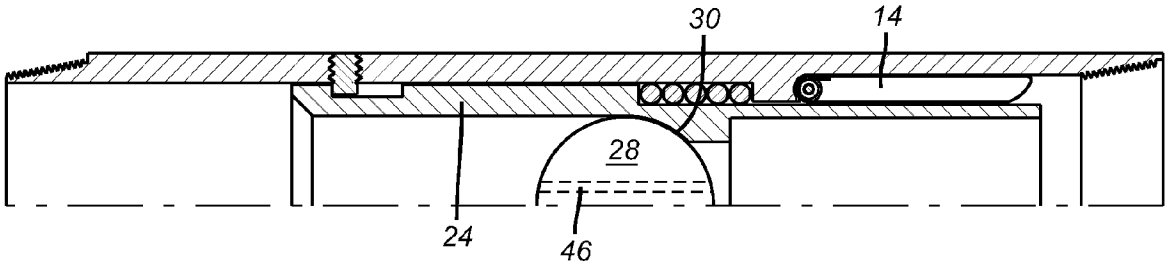
FIG. 2 is the view of FIG. 1 after the object is landed on the actuation sleeve and the sleeve is displaced to compress the return spring.
Figure 4:
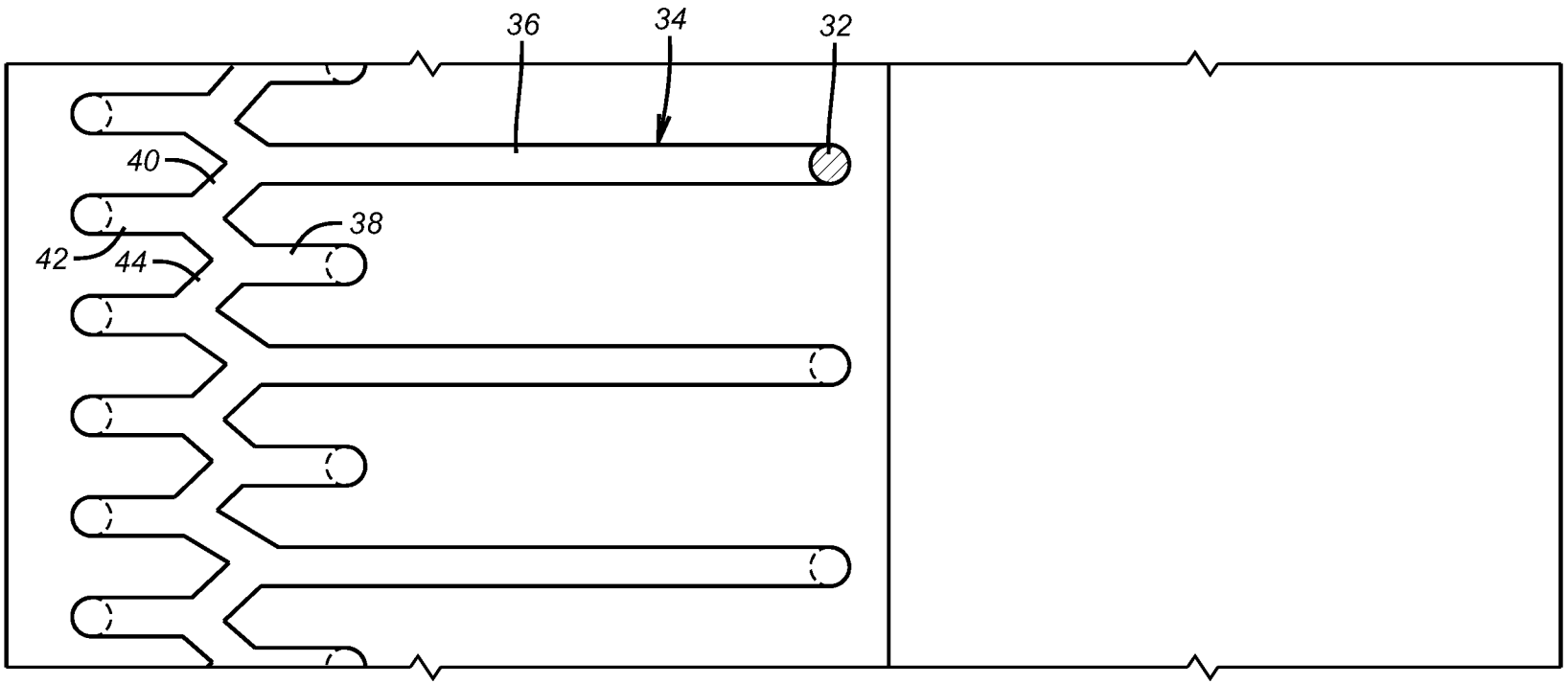
FIG. 4 is an unrolled view of the track for the j-slot for the actuation sleeve.
Figure 5:
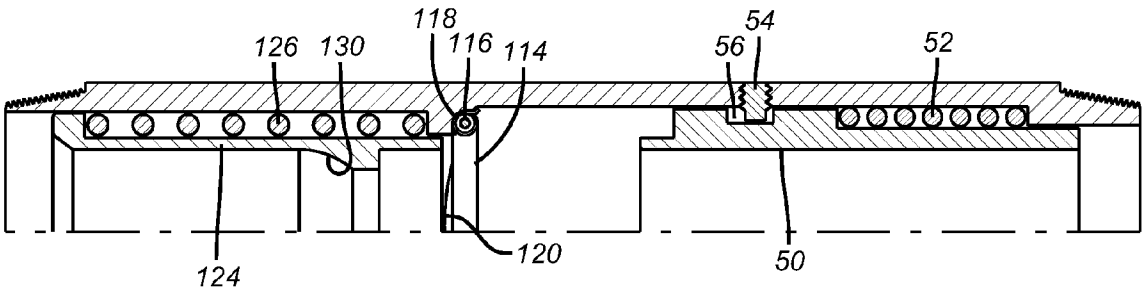
FIG. 5 is the flapper closed view for run in using an alternative embodiment that moves an actuation sleeve against a counting sleeve where the counting sleeve is on a j-slot.

FIG. 1 has a housing 10 with a passage 12 and a flapper 14 that pivots on a pin 16. A torsion spring 18 biases the flapper 14 toward the closed position against the seat 20. An actuating sleeve 24 is slidably mounted in the passage 12 to move against the bias of a return spring 26 when an object such as a ball or plug 28 lands and obstructs the passage 12 at seat 30 as shown in FIG. 2. A pin or screw 32 extends into a j-slot track 34 that is shown rolled open in FIG. 4. The j-slot track 34 has a series of long passages 36 and short passages 38 that alternate. In the FIG. 1 position, the actuating sleeve 24 is at its highest location where spring 26 is extended and the flapper 14 is biased by spring 18 against the seat 20. This can happen because the actuating sleeve 24 in FIG. 1 is not in contact with the flapper 14. In essence the spring 26 advances the actuating sleeve 24 until the long passage 36 hits the pin 32, as shown in FIG. 1.

Dropping the object 28 onto seat 30 and applying pressure moves the sleeve 24 axially and initially without rotation as the long passage 36 with pin 32 extending into it guides the axial movement. When the pin advances to passage 40 there is rotation of the sleeve 24 as the pin enters passage 42 and remains there as long as pressure is held against the object 28. When the pressure is removed in passage 12 on the object 28 the sleeve 24 reverses direction and resumes rotation as the pin 32 rides in passage 44 on the way to passage 38. This is the FIG. 2 position.

Figure 3:
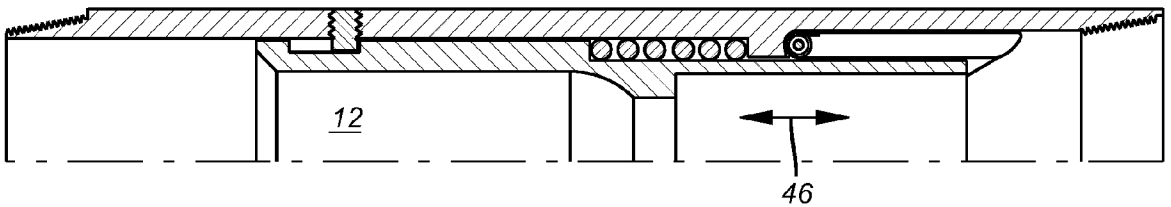
FIG. 3 shows the object dissolved and the passage through the sleeve cleared.

The object 28 is then removed from the seat 30 in one of a variety of ways such as dissolving, chemical reaction, melting, or being ejected through the seat 30. Note that the sleeve 24 has been pushed down to contact the flapper 14 and rotate it 90 degrees so that in FIG. 2 it is behind the sleeve 24 with the spring 26 being compressed. The position of FIG. 2 is held because the pin 32 in short passage 38 is at the end of that passage with the sleeve 24 under a spring force. FIG. 3 is the view of FIG. 2 after the object 28 is no longer on the seat 30. Injection of fluid down passage 12 or production in the opposite direction can now take place as indicated by arrow 46.

Those skilled in the art will appreciate that a single application and removal of pressure cycle has gotten the flapper 14 to go from closed to open and that the landing of a second object (not shown) on seat 30 followed by a pressure cycle of application and removal of pressure will get the pin 32 into the next long passage 36 to allow the sleeve 24 to rise up and away from the flapper 14 so that the torsion spring 18 can close the flapper 14 against its seat 20. While the j-slot 34 is designed for a single cycle of pressure application and removal to move the flapper 14 the j-slot 34 can be designed for multiple cycles before the flapper moves. Since the second object (not shown) lands on the same seat 30, it can have the same shape as the object 28.

As an option to avoid stopping injection when trying to close the flapper while landing a second object (not shown) on seat 30, a small passage 46 (illustratively shown on object 28 but is actually used in the second object that is not shown) is put in so that there is some injection flow through it but the pressure difference across the object is sufficient to move the sleeve 24 so that it can be raised when pressure is removed so that the flapper 14 can close. If such a passage is used it is preferred that the object shape not be round but instead be a cylindrical plug for example so that the passage 46 is in fluid communication with the passage 12 when the object (not shown) lands on seat 30 as the second landed object.

Figure 6:
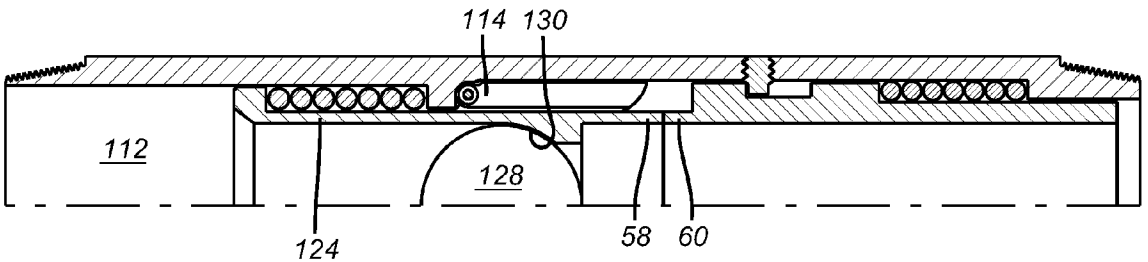
FIG. 6 is the view of FIG. 5 with an object on the seat on the actuation sleeve and both sleeves displaced as pressure is applied.
Figure 7:
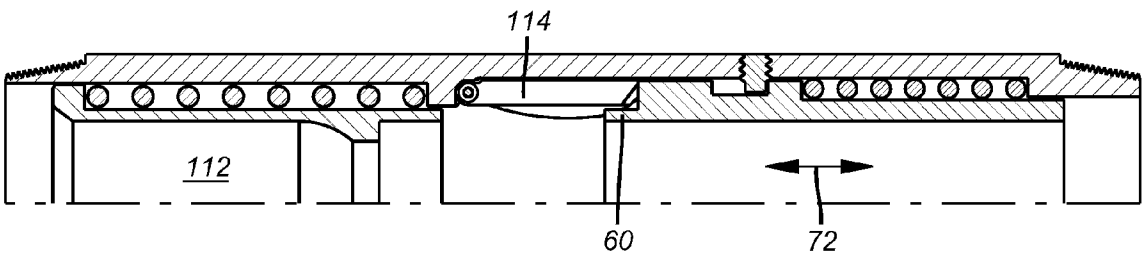
FIG. 7 is the view of FIG. 6 with applied pressure removed and the object dissolved showing the counting sleeve holding the flapper open.

FIGS. 4-9 show an alternative embodiment. Here there is an actuating sleeve 124 biased by a spring 126 but with no j-slot mechanism. As before there is a flapper 114 on a pivot 116 that has a torsion spring 118. The flapper seats on seat 120. Below the flapper 114 there is a counting sleeve 50 biased by a spring 52. A pin 54 extends into a j-slot 56 that is shown rolled out in FIGS. 8 and 9. When the first object 128 lands on seat 130 and pressure is applied in passage 112 the actuating sleeve 124 is pushed down to compress the spring 126 and to push the flapper 114 90 degrees to the open position behind the sleeve 124 as shown in FIG. 6. That same movement of sleeve 124 that opened the flapper 114 has resulted in the lower end 58 hitting the upper end 60 of the counting sleeve 50 and pushing it in tandem with sleeve 124 while compressing the spring 52. In the FIG. 5 position the pin 54 is in the short passage 62. As pressure is applied to the object 128 the sleeve 50 initially moves axially without rotation as pin 54 guides the passage 62 until passage 64 is reached at which time there is translation and rotation followed by translation only as the passage 66 runs past the pin 54. Once the pressure in passage 112 is let off the object 128, the spring 126 pushes up sleeve 124, while the spring 52 pushes up sleeve 50. Sleeve 50 initially only translates down as pin 54 tracks path 66 in the opposite direction before going into path 68 which causes the sleeve 50 to advance axially while rotating until pin 54 reaches path 70 where there is only axial motion of sleeve 50 without rotation. The upper end 60 of sleeve 50, while initially moving in tandem with sleeve 124, stops moving when the upper end 60 is in front of the flapper 114 so that rotation of the flapper from the open position is prevented. The sleeve 124 moves away from the now stationary sleeve 50 until the sleeve 124 resumes its original position. These movements are illustrated in FIG. 7 which also shows that the initial object 128 has been removed using any of the techniques described before. Flow in passage 112 can now occur as indicated by arrow 72. As before, dropping a second object on seat 130 and another pressure cycle gets the device back to the FIG. 5 position and the second object (not shown) can then be removed using the previously described techniques.

Figure 8:
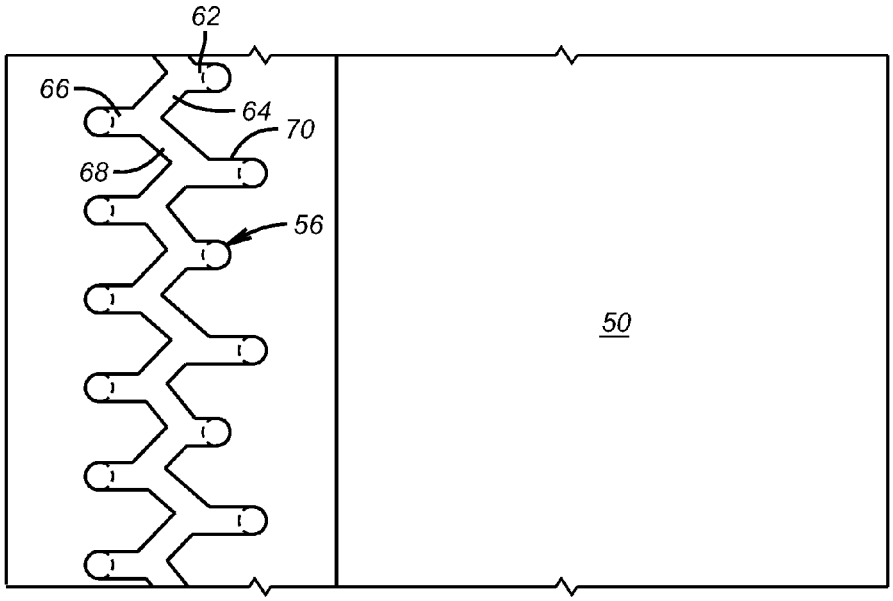
FIG. 8 is an unrolled version of the counting sleeve j-slot track showing a straight lower end.
Figure 9:
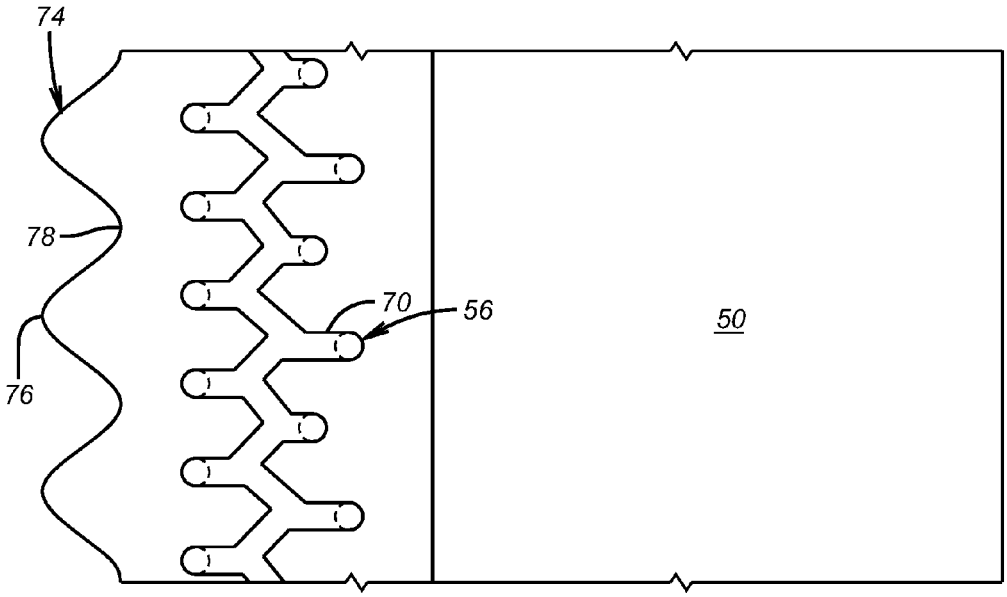
FIG. 9 is an alternative embodiment to FIG. 8 where the lower end of the counting sleeve is scalloped to enhance the amount of protrusion over the flapper when the flapper is retained in the open position.

FIGS. 8 and 9 are identical except for the variation of FIG. 9 having a scalloped end 74 having peaks 76 and alternating valleys 78. This feature extends the reach of the sleeve 50 toward the flapper 114 when the pin 54 is in the long slots 70.

Those skilled in the art will appreciate that the device eliminated the need for a hydraulic control system including control lines and a piston to move the sleeves for operating the flapper. The springs in the design simply offset the weight of the sleeve that they bias independent of the depth of the application. The passage is cleared after the operation of the flapper so that preferably injection can take place with the flapper held open. A second object can be used to release the flapper so it can close. A passage in the object can be optionally provided to continue injection flow with the object being seated. Dissolving the object with an introduced fluid is the preferred way to reopen the flowpath.

The above description is illustrative of the preferred embodiment and many modifications may be made by those skilled in the art without departing from the invention whose scope is to be determined from the literal and equivalent scope of the claims below:

I claim:

1. A barrier valve for subterranean use, comprising a housing having a passage extending between an uphole and a downhole opposed ends thereof and a valve member movable between an open position where said passage is open and a closed position where said passage is closed, said valve member biased to close to retain pressure entering said housing in a direction from said downhole end toward said uphole end and against a seat defined by said housing;

an actuation sleeve in said passage, actuable with at least one application of pressure in said housing acting on said sleeve when a flowpath in said sleeve is temporarily obstructed by something other than said valve, to move axially and operate said valve member more than once between said open and closed positions said actuation sleeve remaining obstructed when said valve member is moved between said open and closed positions.

2. The valve of claim 1, wherein:

said flow path is blocked by at least one object delivered into said passage.

3. The valve of claim 2, wherein:

said valve member comprises a flapper.

4. The valve of claim 3, wherein:

said sleeve displaces and holds said flapper to say open position by at least one cycle of applied and removed pressure.

5. The valve of claim 3, wherein:

said sleeve comprises a seat;

said at least one object comprises a first object to temporarily obstruct said flowpath when said first object is on said seat.

6. The valve of claim 5, wherein:

said sleeve is guided in said housing by a j-slot assembly and movement of said sleeve responsive to pressure on said first object when said first object is on said seat overcomes a biasing member in said housing.

7. The valve of claim 6, wherein:

Said j-slot is configured to maintain said sleeve in position where said flapper is in said open position upon at least one application and removal of pressure on said first object when said object is on said seat.

8. The valve of claim 7, wherein:

said first object is removed from blocking said seat with said flapper retained open by one of melting, dissolving, or chemical reaction.

9. The valve of claim 8, wherein:

said at least one object comprises a second object that blocks said flowpath after said first object is removed from said seat in said sleeve and application and removal of pressure to said second object allows said biasing member to move said sleeve away from said flapper to allow said flapper to move to said closed position.

10. The valve of claim 9, wherein:

Said second object is removed from blocking said seat with said flapper open by one of melting, dissolving, or chemical reaction.

11. A barrier valve for subterranean use, comprising a housing having a passage extending between opposed ends thereof and a valve member movable between an open position where said passage is open and a closed position where said passage is closed;

an actuation sleeve in said passage, actuable with at least one application of pressure in said housing acting on said sleeve when a flowpath in said sleeve is temporarily obstructed, to move axially and operate said valve member more than once between said open and closed positions;

said flowpath is blocked by at least one object delivered into said passage;

said valve member comprises a flapper;

said sleeve comprises a seat;

said at least one object comprises a first object to temporarily obstruct said flowpath when said first object is on said seat;

said sleeve is guided in said housing by a j-slot assembly and movement of said sleeve responsive to pressure on said first object when said first object is on said seat overcomes a biasing member in said housing;

said j-slot is configured to maintain said sleeve in position where said flapper is in said open position upon at least one application and removal of pressure on said first object when said object is on said seat;

said first object is removed from blocking said seat with said flapper retained open by one of melting, dissolving, or chemical reaction;

said at least one object comprises a second object that blocks said flowpath after said first object is removed from said seat in said sleeve and application and removal of pressure to said second object allows said biasing member to move said sleeve away from said flapper to allow said flapper to move to said closed position;

said second object comprises an elongated shape, said elongated shape having a path therethrough to allow flow through said second object during at least one application of pressure that shifts said sleeve, whereupon at least one pressure removal on said second object, said flapper closes.

12. The valve of claim 9, wherein:

said first and second objects comprise spheres.

13. A barrier valve for subterranean use, comprising a housing having a passage extending between opposed ends thereof and a valve member movable between an open position where said passage is open and a closed position where said passage is closed;

an actuation sleeve in said passage, actuable with at least one application of pressure in said housing acting on said sleeve when a flowpath in said sleeve is temporarily obstructed, to move axially and operate said valve member more than once between said open and closed positions;

said flowpath is blocked by at least one object delivered into said passage;

said at least one object comprises an elongated shape, said elongated shape having a path therethrough to allow flow through said object during at least one application of pressure that shifts said sleeve when said valve member is open, whereupon at least one pressure removal, said valve member closes.

14. The valve of claim 3, further comprising:

a counting sleeve disposed on an opposite side of said flapper from said actuation sleeve, said counting sleeve selectively positioned to retain said flapper in said open position.

15. The valve of claim 14, wherein:

said actuation sleeve contacting said counting sleeve after moving said flapper to the open position.

16. The valve of claim 15, wherein:

said actuation sleeve comprises a seat;

said at least one object comprises a first object to temporarily obstruct said flowpath when said first object is on said seat.

17. The valve of claim 16, wherein:

pressure applied to said first object on said seat moves said sleeves in tandem after said sleeves make contact.

18. A barrier valve for subterranean use, comprising a housing having a passage extending between opposed ends thereof and a valve member movable between an open position where said passage is open and a closed position where said passage is closed;

an actuation sleeve in said passage, actuable with at least one application of pressure in said housing acting on said sleeve when a flowpath in said sleeve is temporarily obstructed, to move axially and operate said valve member more than once between said open and closed positions;

said flowpath is blocked by at least one object delivered into said passage;

said valve member comprises a flapper;

a counting sleeve disposed on an opposite side of said flapper from said actuation sleeve, said counting sleeve selectively positioned to retain said flapper in said open position;

said actuation sleeve contacting said counting sleeve after moving said flapper to the open position;

said actuation sleeve comprises a seat;

said at least one object comprises a first object to temporarily obstruct said flowpath when said first object is on said seat;

pressure applied to said first object on said seat moves said sleeves in tandem after said sleeves make contact;

said counting sleeve is biased against movement caused by said actuation sleeve;

said counting sleeve operably connected to said housing with a j-slot assembly and further comprises an upper end defining a recess adapted to retain said flapper in said open position.

19. The valve of claim 18, wherein:

said counting sleeve has an undulating upper end which extends the depth of said recess that engages the flapper to retain said open position.

20. The valve of claim 18, wherein:

at least one cycle of pressure application and removal on said first object allows said j-slot to position said recess to retain said flapper in said open position.

21. The valve of claim 20, wherein:

said actuation sleeve is biased against pressure application to said first object, whereupon at least one removal of pressure from said first object initially moves said sleeves in tandem until said j-slot stops said counting sleeve with said recess in position to block movement of said flapper at a time when said flapper is still held open by said action sleeve.

22. The valve of claim 21, wherein:

said first object is removed from blocking said seat with said flapper retained open by one of melting, dissolving, or chemical reaction;

said at least one object comprises a second object selectively in contact with said seat after removal of said first object and application of at least one cycle of application and removal of pressure on said second object allows said j-slot to retain said recess away from said flapper while said bias on said actuation sleeve moves said actuation sleeve away from said flapper to allow said flapper to close.

23. The valve of claim 22, wherein:

said second object is removed from blocking said seat with said flapper open by one of melting, dissolving, or chemical reaction;

said second object comprises an elongated shape, said elongated shape having a path therethrough to allow flow through said second object during at least one application of pressure that shifts said actuation sleeve, whereupon at least one pressure removal on said second object, said flapper closes.

24. A barrier valve for subterranean use, comprising a housing having a passage extending between opposed ends thereof and a valve member movable between an open position where said passage is open and a closed position where said passage is closed;

an actuation sleeve in said passage, actuable with at least one application of pressure in said housing acting on said sleeve when a flowpath in said sleeve is temporarily obstructed, to move axially and operate said valve member more than once between said open and closed positions;

said flowpath is blocked by at least one object delivered into said passage;

said valve member comprises a flapper;

a counting sleeve disposed on an opposite side of said flapper from said actuation sleeve, said counting sleeve selectively positioned to retain said flapper in said open position;

said at least one object comprises an elongated shape, said elongated shape having a path therethrough to allow flow through said object during at least one application of pressure that shifts said actuation sleeve when said valve member is open, whereupon at least one pressure removal, said valve member closes.

25. The valve of claim 23, wherein:

said first and second objects comprise spheres.

* * * * *